US005263217A

United States Patent [19]

Miglietti

[11] Patent Number: 5,263,217

[45] Date of Patent: Nov. 23, 1993

[54] SWING BRIDGE FOR THE SPANNING OF WATERCOURSES

[76] Inventor: Giovanni Miglietti, Via Antica Zecca, 13-48100 Ravenna, Italy

[21] Appl. No.: 851,741

[22] Filed: Mar. 16, 1992

[30] Foreign Application Priority Data

Mar. 20, 1991 [IT] Italy ..... RA91A000003

[51] Int. Cl.[5] ..... E01D 15/04; E01D 15/06; E01D 15/08

[52] U.S. Cl. ..... 14/32; 14/37; 14/27

[58] Field of Search ..... 14/27-28, 14/31-32, 35-37

[56] References Cited

U.S. PATENT DOCUMENTS

| | | | |
|---|---|---|---|
| 175,019 | 3/1876 | Borgfeldt | 14/27 X |
| 383,880 | 6/1888 | Harman | 14/37 |
| 1,078,293 | 11/1913 | Leslie | 14/37 |
| 1,106,259 | 8/1914 | Turner | 14/32 |
| 4,169,296 | 10/1979 | Wipkinr et al. | 14/37 X |
| 4,590,634 | 5/1986 | Williams | 14/27 X |
| 4,621,385 | 11/1986 | Gillois | 14/27 X |

FOREIGN PATENT DOCUMENTS

| | | | |
|---|---|---|---|
| 385798 | 5/1988 | Austria . | |
| 211883 | 5/1907 | Fed. Rep. of Germany . | |
| 421128 | 11/1925 | Fed. Rep. of Germany . | |
| 3814352 | 9/1989 | Fed. Rep. of Germany | 14/37 |
| 1223544 | 6/1960 | France . | |
| 391993 | 12/1973 | U.S.S.R. | 14/37 |
| 495403 | 3/1976 | U.S.S.R. | 14/37 |

*Primary Examiner*—Kenneth J. Dorner
*Assistant Examiner*—Nancy P. Connolly
*Attorney, Agent, or Firm*—Dvorak and Traub

[57] ABSTRACT

The swing bridge for the spanning of watercourses, defined by a first bank and by a second bank on which there are tracts of road surface, is constituted by a first mobile plane restable, at its first end on the said first bank and is supported, at its other end in proximity to the said second bank with possibility of free rotation about its vertical axis passing through its own longitudinal axis of symmetry and defined by a vertical hinge pivot; the second end of the said mobile plane being hinged about its horizontal transversal axis to the said hinge pivot and having hinged to itself a connecting plane of the mobile plane with the second bank; between the mobile plane and the connecting plane there being envisaged movement organs of the said connecting plane and the mobile plane bearing inferiorly at least one floating hollow body with adjustable trim which raises or lowers the said first end and nautical propulsion organs which move the said mobile plane in rotation about the said hinge pivot after the said mobile plane and the said connecting plane have been raised from the said banks.

11 Claims, 1 Drawing Sheet

FIG1
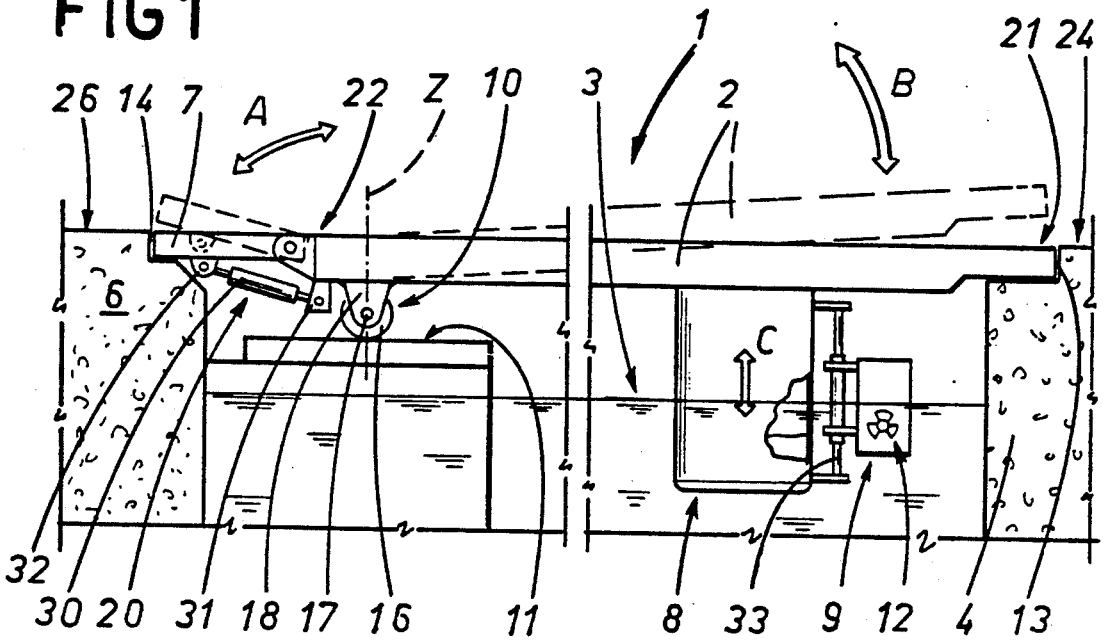
FIG2
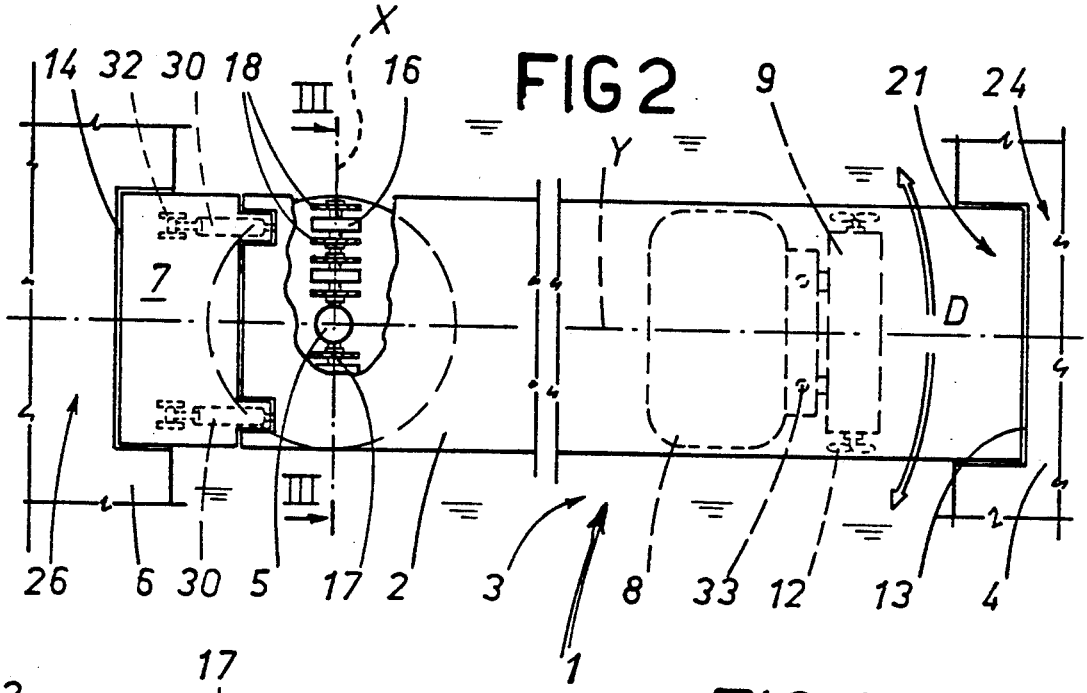
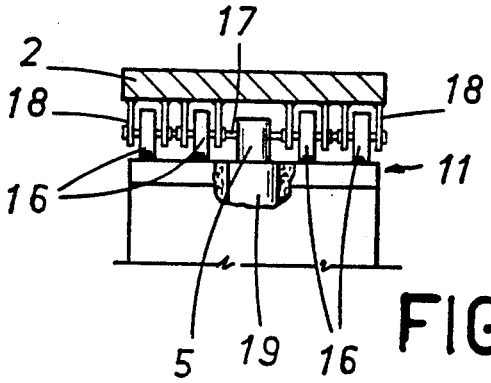
FIG3
FIG4
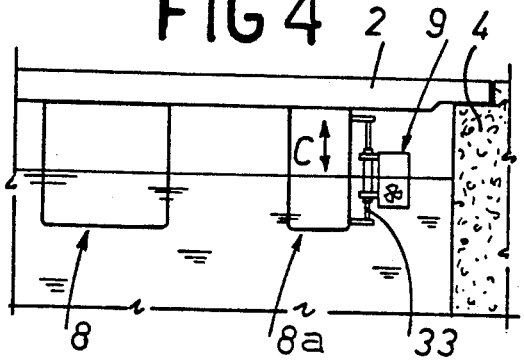

SWING BRIDGE FOR THE SPANNING OF WATERCOURSES

BACKGROUND OF THE INVENTION

The invention relates to swing bridge for the spanning of watercourses.

In particular, the present invention has the aim of providing a swing bridge which permits of connecting two tracts of road surface realised on the banks of a watercourse, more specifically a canal, and which permits quickly of forming the said road connection so as to leave the said canal free for water-borne traffic.

SUMMARY OF THE INVENTION

The invention, as characterised in the claims which follow, solves the above-described problem by providing a swing bridge for the spanning of watercourses defined by a first bank and a second bank on which the said respective road surfaces are realised, which bridge is characterised by the fact that it is constituted by a mobile plane with prevalently longitudinal development, and which is able to be rested, at the first of its ends, on the said first bank and supported, near to its second end, in proximity to the said second bank, with the possibility of free rotation about a vertical axis passing through its longitudinal axis of symmetry; the said mobile plane being hinged, about its horizontal transversal axis and in proximity to its second end, to a vertical hinge pivot which pivot's axis coincides with the said vertical free rotation axis and is fixed, rotatably idle about its axis, to a base which base is part of or arranged in proximity to the said second bank; a mobile connecting plane being hinged, at the second end, to the said mobile plane, said connecting plane being mobile, by means of movement organs, between a lowered position, in which the connecting plane rests on the nearby second bank in a substantially level position with respect to the said mobile plane, and in a raised position for the movement of the said mobile plane. The said mobile plane exhibits, inferiorly and in proximity to its first end, a floating hollow body with variable trim, partially immersed in the water of the canal and able, by varying its trim, to raise or leave in the resting position the said first end on the said first bank; bi-directional nautical propulsion organs being envisaged, connected to the said mobile plane in proximity to the said floating hollow body for the movement of the said mobile plane about the said hinging pivot after the said hollow floating body has raised the first end of the mobile plane from the first bank and after the raising operation of the said movement organs of the said connecting plane for the said second bank.

BRIEF DESCRIPTION OF THE DRAWINGS

The invention will be discussed in more detail in the description which follows, made with reference to the accompanying drawings, which represent a non-limiting preferred embodiment, in which:

FIG. 1 shows, with some parts in section in order better to illustrate others, a lateral view of the swing bridge object of this invention;

FIG. 2 shows, in plan view, the swing bridge of FIG. 1;

FIG. 3 shows the section along line III—III of FIG. 2; and

FIG. 4 shows a constructional variant with reference to FIG. 1.

DESCRIPTION OF THE PREFERRED EMBODIMENTS

With reference to the drawings, 1 denotes a swing bridge according to the invention, used for the spanning of watercourses 3 defined by a first embankment or bank 4 and a second bank 6, on which tracts of road surface 24 and 26 are realised. The swing bridge 1 comprises, essentially, a mobile support body or mobile plane 2 having a prevalently longitudinal development and restable, at its first end 21 on the said first bank 4. The second end 22 of the mobile plane 2 is supported in proximity to the second bank 6, with the possibility of freely rotating about its vertical axis Z passing through its longitudinal axis of symmetry Y.

The said second end 22 of the mobile plane 2 is hinged, around its horizontal transversal axis X to a vertical hinge pivot 5 which hinge pivot's 5 axis coincides with the vertical rotation axis Z of free rotation. The hinge pivot 5 is set, freely and idle about its own axis, in a base 11 being part of or arranged in proximity to the said second bank 6. The mobile plane 2 has thus two degrees of freedom inasmuch as it can rotate about the horizontal X and the vertical Z axes: the first degree of freedom permits of the raising and the lowering of the said first end 21, while the second degree of freedom permits of the nearing or distancing, on a horizontal plane, of the same first end 21 to or from the said first bank 4.

Below the second end 22 mobile means of support 10 are envisaged, constituted by a plurality of wheels 16, idle on coaxial axles or shafts 17 supported by brackets 18 fixed inferiorly to the said mobile plane 2 as shown also in FIG. 3. In FIG. 3 four idle wheels 16 are shown, supported by three shafts 17 of which the central shaft crosses the upper end of the hinge pivot 5, so that the axis of the coaxial shafts 17 coincides with the axis X of the horizontal hinge of the mobile plane 2. The idle wheels 16 rest on the base 11 and provide for the mobile plane 2 a secure and solid support on the side of the second bank 6.

As can be seen by comparing FIGS. 2 and 3, the hinge pivot 5 is cylindrical and is housed rotatably idle inside a respective tubular support 19 fixed into the base 11.

In a case such as that illustrated in FIG. 2, wherein the second end 22 of the mobile plane 2 is restable in a respective seating 14 sunk into the said second bank 6, in order that no gap should exist between the mobile plane element 2 and the respective road tract 26, a connecting plane 7 is hinged to the said second end 22, about a transversal axis on the latter, which connecting plane 7 rests on the second bank 6 and acts as a connecting plane for the mobile plane 2 to the side of the said second bank 6 and acts as a connecting plane for the mobile plane 2 to the side of the said second bank 6. Movement organs 20 are envisaged between the mobile plane 2 and the connecting plane 7, composed of a pair of flow-dynamic cylinders 30 arranged below the said mobile plane 2 and connecting plane 7 and anchored by their opposite ends to respective pairs of brackets 31 and 32 fixed inferiorly to the mobile plane 2 and respectively to the connecting plane 7 as illustrated in FIG. 1.

When the swing bridge 1 connects the two tracts of road surface 24 and 26, the first end 21 of the mobile plane 2 and the free end of the connecting plane 7 house in corresponding seatings 13 and 14 sunk into the two banks 4 and 6 at depths equal to the thickness of the corresponding ends to avoid disparity of level between the said swing bridge 1 and the said tracts of road 24 and 26. The transversal sections of the seatings 13 and 14 and of the respective ends 21 and 22 are truncoconical, with their shorter sides below for a faster and more secure fitting of the swing bridge 1 as will be described hereinafter.

In proximity to its first end 21, the mobile plane 2 bears inferiorly a hollow floating body 8 and bi-directional water-propulsion organs 9. The hollow floating body 8 develops transversally to the mobile plane 2 and is of the type with adjustable trim, that is it is provided with means (not illustrated) able to vary its floating level, for example by means of the introduction or extraction of water to or from its inside. The dimensions of the hollow floating body 8 are such that during adjustment of its trim (see arrow C in FIG. 1), it is able to raise or lower the first end 21 of the mobile plane 2, that is, it can rotate the mobile plane about the common axis X of the shafts 17 (see arrow B in FIG. 1).

The propelling organs 9, for example a propeller- or jet-type motor or similar, are supported by the floating body 8 and, more exactly, are freely mobile along a pair of guide rods 33, which guide rods 33 are solid to the hollow floating body 8 in order to keep their active elements 12, that is, their propeller or the outlet mouth of the jet-propeller, always immersed in the watercourse 3. As is illustrated in FIG. 2, the propelling organs 9 act transversally to the mobile plane 2 and in both advancement directions.

Command means (not illustrated) for the various motor organs of the invention are also envisaged, that is, the movement organs 20, the nautical propulsion organs 9, means for the adjustment of the trim of the hollow floating body 8, for the movement of the swing bridge 1, as will be described hereinafter.

In whatever configuration assumed by the swing bridge 1, the idle wheels 16 rest on the base 11 and support the second end 22 of the mobile plane 2. When the swing bridge 1 is used for the connecting of two tracts of road surface 24 and 26, the first end 21 of the mobile plane 2 rests on the bottom of its respective seating 13 and the free end of the connecting plane 7 rests in its respective seating 14 in such a way that there is no gap between the two tracts of road surface 24 and 26. Should a craft wish to pass through the swing bridge 1, first the connecting plane 7 is raised by action of the flow-dynamic cylinders 30, (see FIG. 1, arrow A) then the mobile plane 2 (see FIG. 1 arrow B) is raised, by adjustment to the trim of the hollow floating body 8 (see FIG. 1 arrow C). Then, after the free end of the connecting plane 7 has totally exited from its relative seating 14 and the first end 21 has exited from its relative seating 13, the propulsion organs 9 are activated, whose active elements 12 are still immersed in the watercourse 3 thanks to their freedom of up-and-down movement, to move the first end 21, that is to rotate the mobile plane 2 about the hinge pivot 5 until the watercourse 3 is freed for the craft's passage. After such passage, in order to close the swing bridge 1 the trim of the floating hollow body 8 is adjusted in the opposite direction to the preceding in order to lower the first end 21 of the mobile plane 2. Usually the first end 21 exhibits a trapezoid section (not illustrated) which permits of its precise positioning inasmuch as it finds its respective seating 13 during its lowering. Successively to this, the free end of the connecting plane 7 is lowered by action of the flow-dynamic cylinders 30.

The principal advantage of the present invention consists in its operative speed, in that the central arrangement of its vertical rotation axis Z coinciding with the axis of the hinge pivot 5 permits of always rotating the entire swing bridge 1 in the direction away from the craft, which can therefore advance during the opening phase of the swing bridge 1. This rapidity is increased by the arranging of the hollow floating body 8 transversally to the mobile plane 2, and thus longitudinally to the advancement direction of the said floating hollow body 8 in the watercourse 3. Such an arrangement of the floating hollow body 8, apart from increasing the movement velocity of the mobile plane 2 about the hinge pivot 5, permits of leaving a part of the watercourse 3 free so that smaller craft can pass below the mobile plane 2 without the need to act on the swing bridge 1. The possibility of rotating the mobile plane 2 in both directions provides also a greater security of functioning inasmuch as it is no longer necessary, on the part of the craft, to observe a determined security distance from the swing bridge 1 during its opening.

A further advantage of the present invention is constituted by its sturdiness and the stability of the swing bridge 1, made possible by the fact that the said swing bridge 1, during the connection phase of the tracts of road surface 24 and 26, rests on stable elements independently of any eventual variations in static levels or dynamics vis-à-vis the watercourse, that is, the banks 4 and 6, and the base 11.

The invention as conceived is susceptible to numerous modifications without forsaking the inventive concept: one of these modifications, for example, is illustrated in FIG. 4, where the mobile plane 2 of the swing bridge 1 bears inferiorly a first and a second floating hollow body 8 and **8*a* having adjustable trim and being partially immersed in the watercourse 3**.

The first floating hollow body 8 arranged for example more centrally to the mobile plane 2, does not exert a push on the said mobile plane 2 sufficient to lift it, while the second floating hollow body **8*a* is able, by adjustment of its trim and in collaboration with the push exerted by the first floating hollow body 8, to exert a variable push capable of lifting or leaving at rest the first end 21 of the mobile plane 2 on the first bank 4**. Furthermore, all the details can be replaced with technically equivalent elements.

What is claimed:

1. A swing bridge for spanning a watercourse having a first embankment and a second embankment, the swing bridge comprising:

a mobile support body having a first end and a second end, the first end supported by the first embankment;

a base fixedly disposed proximate the second embankment, the base supporting the mobile support body proximate the second end;

a vertical hinge pivot interconnecting the mobile support body and the base;

a horizontal hinge interconnecting the mobile support body and the vertical hinge pivot;

a floatable body connected to the mobile support body, the floatable body partially immersed in the watercourse;

means for adjusting the immersion of the floatable body; and means for propelling the floatable body through the watercourse wherein the first end of the mobile support body may be raised above the first embankment and the mobile support body may swing about the vertical hinge pivot.

2. The swing bridge of claim 1 further comprising:

a mobile connecting body disposed between the second embankment and the mobile support body;

a hinge interconnecting the second end of the mobile support body and the mobile connecting body; and a seating disposed on the second embankment wherein the seating supports the mobile connecting body.

3. The swing bridge of claim 2 further comprising a mobile support interconnecting the mobile support body and the base.

4. The swing bridge of claim 1 wherein the means for propelling the floatable body is interconnected to the floatable body.

5. The swing bridge of claim 1 wherein the floatable body comprises:

a first floatable body; and a second floatable body adjustably immersable.

6. The swing bridge of claim 3 wherein the mobile support comprises a wheel rotatable about a horizontal axle, the horizontal axle interconnecting the mobile support body and the wheel.

7. The swing bridge of claim 6 wherein the means for propelling the floatable body through the watercourse comprises a propeller.

8. The swing bridge of claim 1 wherein the means for propelling the floatable body through the watercourse comprises a propeller.

9. The swing bridge of claim 7 wherein the floatable body comprises:

a first floatable body; and a second floatable body adjustably immersable.

10. The swing bridge of claim 9 further comprising a seating disposed on the first embankment wherein the seating supports the first end of the mobile support body.

11. The swing bridge of claim 2 further comprising a flow-dynamic cylinder interconnecting the mobile support body and the mobile connecting body.

* * * * *